US005470438A

United States Patent [19]

Sollinger et al.

[11] Patent Number: 5,470,438

[45] **Date of Patent: * Nov. 28, 1995**

[54] WIRE OR FELT FORMING SECTION WITH BREAST ROLLERS SUPPORTED BY HYDROSTATIC BEARINGS

[75] Inventors: Hans-Peter Sollinger; Christian Schiel, both of Heidenheim, Germany

[73] Assignee: J. M. Voith GmbH, Germany

[ * ] Notice: The portion of the term of this patent subsequent to Oct. 12, 2010, has been disclaimed.

[21] Appl. No.: 288,893

[22] Filed: Aug. 10, 1994

Related U.S. Application Data

[63] Continuation of Ser. No. 54,005, Apr. 26, 1993, abandoned, which is a continuation of Ser. No. 839,341, Feb. 20, 1992, Pat. No. 5,252,186.

[30] Foreign Application Priority Data

Feb. 20, 1991 [DE] Germany ..... 41 05 215.3

[51] Int. Cl.[6] ..... D21F 1/36

[52] U.S. Cl. ..... 162/273; 162/300; 162/301; 384/116

[58] Field of Search ..... 162/272, 273, 162/203, 300, 301, 358.3; 492/7; 384/116

[56] References Cited

U.S. PATENT DOCUMENTS

| | | | |
|---|---|---|---|
| 2,881,675 | 4/1959 | Thomas | 162/301 |
| 3,440,136 | 4/1969 | Nelson et al. | 162/203 |
| 3,623,945 | 11/1971 | Tommeraasen | 162/303 |
| 3,853,698 | 12/1974 | Mohr | 162/338.3 |
| 3,909,080 | 9/1975 | Hallnor et al. | 384/116 |
| 4,060,288 | 11/1977 | Arsenius et al. | 384/116 |
| 4,288,571 | 10/1980 | Biondetti | 492/7 |
| 4,530,227 | 7/1985 | Schlatter et al. | 384/116 |
| 4,609,435 | 9/1986 | Tissori | 162/203 |
| 5,084,138 | 1/1992 | Ewald | 162/301 |

*Primary Examiner*—Karen M. Hastings

*Attorney, Agent, or Firm*—Ostrolenk, Faber, Gerb & Soffen

[57] ABSTRACT

A wire or felt forming section of a paper-making machine has breast rollers for guiding a respective one of two forming wires. The two rollers are disposed with a pulp gap formed between the two rollers and the wires are disposed just downstream of a pulp suspension ejecting nozzle of a headbox. Each roller is supported against the respective taut forming wire by a hydrostatic bearing. The hydrostatic bearing has two circumferentially separated resiliency chambers provided in a combined region of resiliency disposed over an arc of the circumference of the roller. A sealing strip after the region of resiliency prevents fluid from contacting the wire.

40 Claims, 3 Drawing Sheets

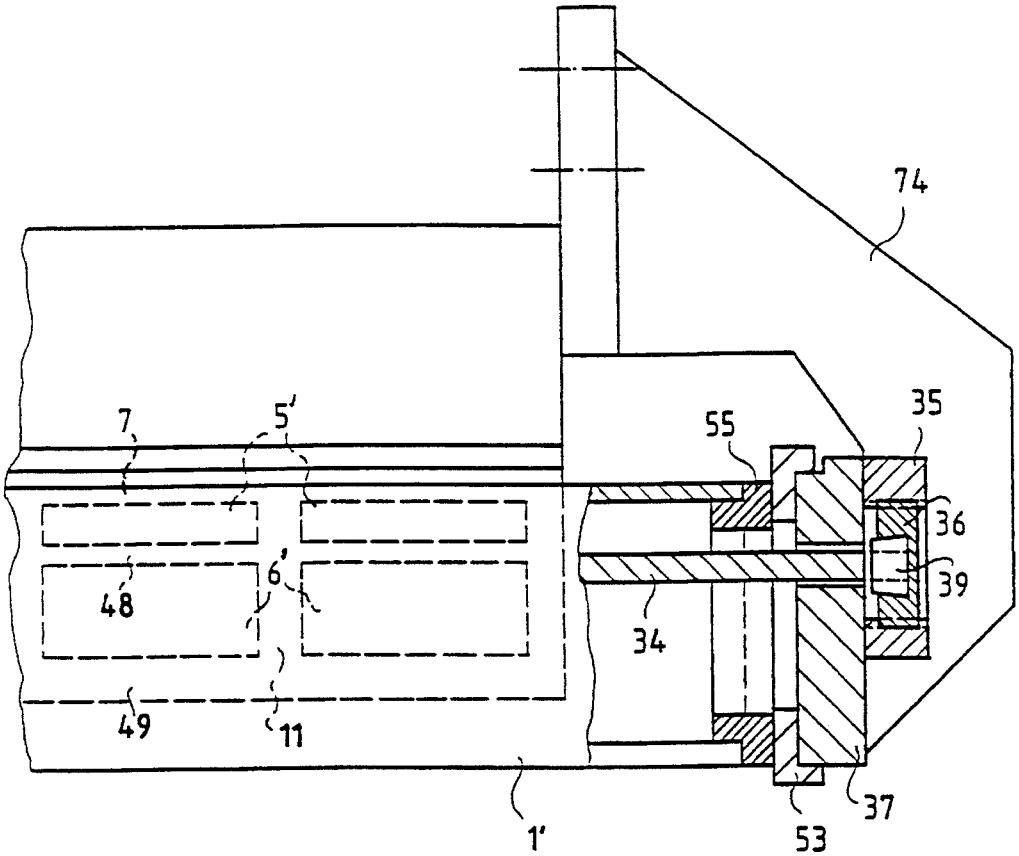
Fig.2
Fig.4
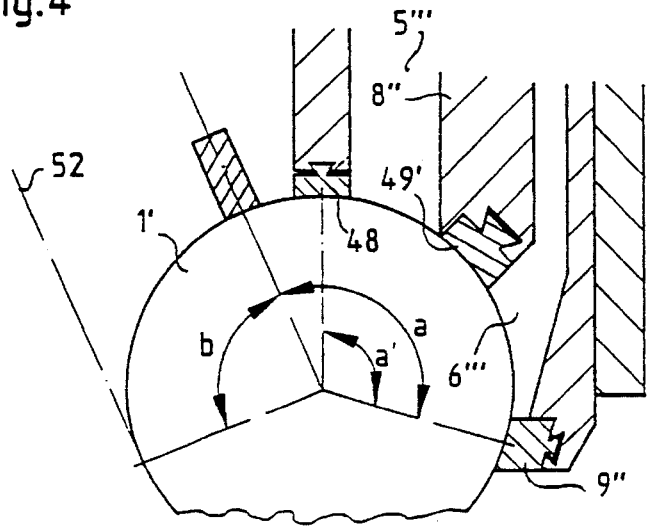

WIRE OR FELT FORMING SECTION WITH BREAST ROLLERS SUPPORTED BY HYDROSTATIC BEARINGS

This is a continuation of application Ser. No. 08/054,005 filed on Apr. 26, 1993 now abandoned, which is a continuation of application Ser. No. 07/839,341 filed on Feb. 20, 1992 now U.S. Pat. No. 5,252,186.

BACKGROUND OF THE INVENTION

The present invention relates to a wire or felt forming section of a paper making machine having rollers that guide the wire or felt through the initial part of the forming section. The wire or felt forming section includes an endless loop wire screen, usually called a wire, or an endless loop fabric layer, usually called a felt, that conveys and dewaters paper pulp suspension that is ejected from the headbox of a paper-making machine onto the wire or felt. Where the suspension is ejected into a gap between two wires or felts, that is a twin wire forming section. Hereafter, only a wire forming section is specifically discussed. But, a felt forming section is to be understood as included as well.

A wire or felt forming section of this type is known from German Patent Publication 3 815 470 A1.

When a wire in a paper making machine is very wide, i.e. wider than 9 m. for example, the rollers which direct the wire past the outlet slot or nozzle from the headbox, and which are known as breast rollers, must be 1 m. or more in diameter to reduce buckling of the wire. Two wires approach the headbox outlet slot, one from above and one from below, respectively. The wires are each wrapped around part of the circumference of a respective breast roller above and below the outlet slot. There are two parallel breast rollers disposed at opposite sides of the outlet slot for guiding the two wires. A gap is formed between the two wires just past the outlet slot by the placement of the breast rollers. A jet of paper pulp suspension is ejected from the headbox outlet slot into the gap between the two wires. Because of the large diameter of the rollers, the distance the paper pulp jet has to travel between the two wires from the headbox nozzle to the pulp gap, which is near where the circumferences of the cooperating breast rollers are closest together, is accordingly very long. In order to reduce this distance, a comparable system, which is disclosed in European Patent Publication 0 335 821 A2, has rigid lead through guides for the wires in the form of respective ceramic strips, instead of breast rollers. The wires rub against the strips considerably and will wear out rapidly.

A guiding, lead through or breast roller is generally a cylinder with a journal at each end. Because of the maximum permissible sag or to avoid critical or even semi-critical speeds, the diameter of such a cylinder is selected dependent upon the width of the machine and upon how rapidly the cylinder rotates. Lead through rollers with diameters of 0.7 to 0.9 m and breast rollers with diameters of 1000 to 1250 mm are now in common use. Such diameters are often much greater than what they should be for optimal design.

It is important to keep the pulp jet leaving the outlet slot of the headbox as free as possible of turbulence, of friction with the air, and of pulp flow components that are at an angle to the direction of pulp and wire travel. This requires keeping the distance the jet travels between the headbox outlet slot and the point at which it strikes the wire or wires of the forming section as short as possible. This point is at the beginning of the pulp gap in a twin wire machine. The breast rollers must accordingly be as small in diameter as possible.

SUMMARY OF THE INVENTION

It is an object of the present invention to provide a wire or felt forming section for a paper making machine, having breast rollers located after the headbox outlet slot and each breast roller having a very small diameter, for the purpose of decreasing the distance traveled by the pulp jet from the headbox outlet nozzle to the beginning of the pulp gap between the two wires.

The above and other objects of the invention are achieved with a twin wire guiding arrangement comprising two generally parallel breast rollers, and each roller guides a respective paper making machine forming section wire. Each wire is continuous or is an endless loop and each is maintained under tension. The two wires define a pulp gap between them as they are brought near to each other as they pass over the two breast rollers. Each wire is guided over its respective roller. A pulp suspension ejection nozzle or outlet slot is disposed adjacent the breast rollers and upstream of the pulp gap.

Each breast roller is supported in a bearing block, against the tension of the wire wrapped partially around it, by a hydrostatic bearing which opposes the force of the wire on the roller. The use of hydrostatic bearings allows the rollers to be reduced in diameter, as compared with previous breast roller diameters required for similar forming sections, thereby decreasing the distance that the pulp jet must travel to the pulp gap between the rollers.

An embodiment of the invention employs an upper and a lower breast roller respectively located above and below the outlet slot from the headbox. Those rollers are generally parallel and their peripheries are near to each other where they define a pulp gap. The breast rollers are in the form of hollow cylinders.

At least the upper breast roller preferably accommodates suspension means that extend at least over the axial length of that roller and prevent the roller from falling out of its bearings while the upper wire, which ordinarily holds the upper roller in position, is absent, e.g., is being replaced. This is an important feature in forming sections in which the pulp gap extends essentially vertically between the two wires, where the breast rollers are one above the other. The suspension means are preferably one of a taut cable, pipe, rod, or band. To prevent the suspension means from oscillating too rapidly as the roller revolves, the suspension means can also have fenders mounted on it. The fenders contact the inner surface of the roller and suppress oscillations in the suspending cable, pipe, rod, or band.

Depressurization channels at the hydrostatic bearing block and bores for carrying away leaked hydrostatic fluid, typically water, are also advantageous to prevent the bearing block from floating in its guide or bearing.

Means, like appropriate sealing strips, prevent a significant volume of liquid from the hydrostatic bearing from reaching the wire, belt, or felt.

The roller used with the invention need not, of course, necessarily be a breast roller or a wire-and-former roller. It can be any roller that guides a wire or felt.

Another advantage of the invention is that the roller can be precisely positioned along its entire length. Hydrostatic support can alternatively be provided only at certain sections along the axis of the roller. This may entail, for example, positioning wide separating webs between the individual longitudinally separate bearing sections. Continuous hydrostatic roller support over the entire roller length, however, is preferable.

The invention also relates to particular features of a hydrostatic bearing for a roller, which bearing is useful in other contexts than as a breast roller for a forming wire. The roller has a circumference and an arc of the circumference comprises a region of resiliency or support provided by a hydrostatic liquid bearing. The bearing block for each roller is divided along the arcuate region of resiliency into at least one and preferably at least two circumferentially separated resiliency chambers defined by circumferentially spaced apart, axially extending webs defined in the bearing blocks. A first end web is provided at the entrance end of the region where the circumference of the roller enters the region of resiliency. A second exit end web is provided where the hydrostatic bearing liquid flows out of the bearing.

Other features and advantages of the present invention will become apparent from the following description of the invention which refers to the accompanying drawings.

BRIEF DESCRIPTION OF THE DRAWINGS

The invention is described in the following detailed description with reference to the drawings, in which:

FIG. 2 is atop view illustrating the upper roller system;

FIG. 4 illustrates still another embodiment of the invention, showing the angular positions between certain components.

DESCRIPTION OF THE PREFERRED EMBODIMENTS

Figure 1:
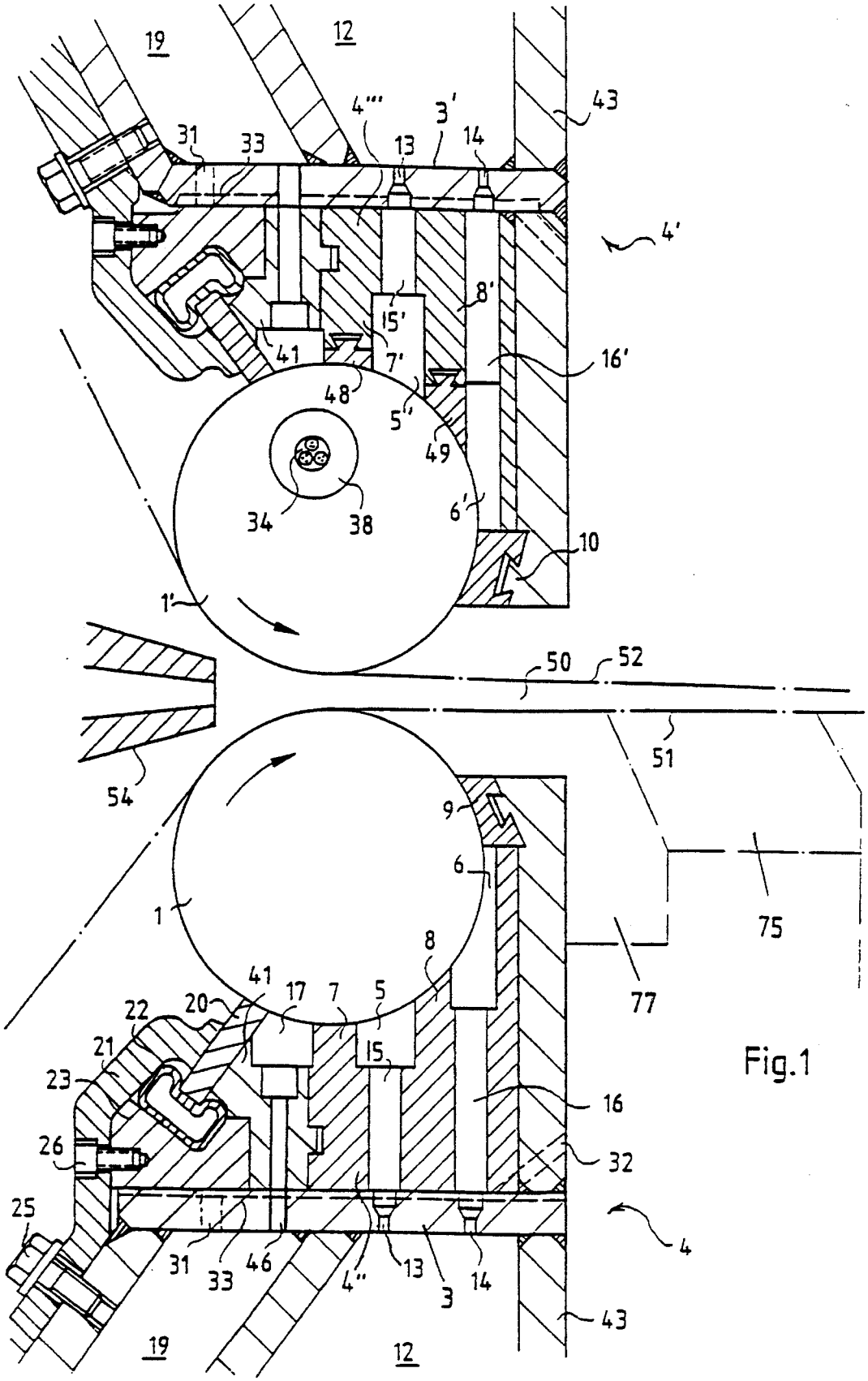
FIG. 1 is a cross-section through the system of bearings supporting two breast rollers in a twin wire or felt forming section of a paper making machine.

Referring to FIGS. 1 and 2, the system of hydrostatic bearings supporting the upper breast roller illustrated in FIG. 1 is substantially mirror-symmetrical with the system of bearings supporting the lower breast roller. Identical parts are labeled with the same reference numbers and similar parts are labeled with the same reference numbers with one or more primes.

Cylindrical breast rollers 1 and 1' are made of metal or of fiber reinforced plastic. They have a covering of either an elastomeric or a hard material, e.g. if an elastomer, a soft polyurethane with a Shore A hardness of 80 to 90. The rollers 1 and 1' rest on respective hydrostatic bearings 4 and 4' which are in turn supported on welded crossbeams 43. The bearings comprise main bearing blocks 4" and 4'" that accommodate circumferentially separated, water filled, resiliency chambers 5, 5' and 6, 6'. The chambers are separated by webs 7, 7' and 8, 8' which are parts of the respective bearing blocks 4" and 4'". The webs have concavely curved top ends that all match the curvature of the respective rollers.

Webs 9 are provided at the roller entrance ends of the two bearing blocks. The webs 9 are not part of their bearing blocks 4 and 4' in the illustrated embodiment, but are instead secured to the beam 43 separately by way of a groove 10 in the web 9 having a dovetail cross-section which receives a mating projection from a portion of the crossbeam 43. As is evident from FIG. 2, chambers 5' and 6' are divided into longitudinally separated compartments by the longitudinally spaced apart, arcuate partitions 11.

The main bearing blocks 4" and 4'" can be removed from the hydrostatic bearings 4 and 4' for maintenance or replacement by sliding them out laterally. One component 41 is fastened securely to each crossbeam 3 and 3' and secures the other components.

The resiliency chambers 5, 5' and 6, 6' are supplied with hydrostatic bearing liquid, typically water, from a channel 12, through nozzles 13 and 14 in the crossbeam portion 3 or 3' and bores 15 and 16. The water being forced through the chambers lifts the breast rollers 1 and 1' off the webs 7, 8, and 9 and escapes over the webs 7 and 8. The water escaping over the web 7 enters a substantially unpressurized water reintroduction chamber 17, and then a reintroduction channel 19 through bores 46 in batten shaped block component 41.

A sealing strip 20 strips off a sheet of water that escapes between the breast roller 1 or 1' and the web 7 or 7' forcing the water into reintroduction chamber 17 and from there into reintroduction channel 19.

The sealing strip 20 is slidably disposed in a slot between the block component 41 and a retaining strip 21 and may be forced against the breast roller 1 or 1' by a tubular cushion 22 that can be inflated to various pressures. Another batten shaped retaining component 23 includes a depression to accommodate the cushion 22 and is secured to the retaining strip 21 by suitable means, such as screws 26. The retaining strip 21 is secured to a portion of the welded crossbeam 43 by screws 25.

The webs 7' and 8' in the upper bearing block 4'" are provided with respective separate sealing strips 48 and 49, which are secured in the dovetail grooves. Those strips have sliding contact surfaces that conform to the circumference of the breast roller 1'. The sliding contact surfaces on the strips 48, 49, as well as those surfaces on the webs 7 and 8, are approximately half as wide as the resiliency chambers 5 and 6 and 5' and 6' in the direction along the circumference of the roller. Preferably, the resiliency chambers are between 1.25 and 3.5 times as wide along the circumference of the rollers as the width of the webs in the direction of roller rotation. Preferably, the web surfaces are lined with PTFE (polytetrafluoroethylene) or ceramic.

Taut forming section wires 51 and 52 partially wrap around the respective breast rollers 1 and 1' and force the rollers against the respective hydrostatic bearings 4 and 4'. The wires are of conventional design and taut holding thereof is done conventionally.

Each roller circumference, as shown in FIG. 1, forms a first arc disposed against the bearing diametrically opposite a second arc of the circumference that the wire or felt 51, 52 engages.

A taut cable 34 extends laterally through the upper breast roller 1' and prevents it from falling out of its bearings while the wire is absent, e.g., as it is being changed. Instead of a cable 34, other devices could also be used, e.g., a pipe, rod, band or wire.

Depressurization channels 33 and bores 31 and 32 prevent the bearing blocks 4" and 4'" from "floating".

Mounted on the bracket 74 illustrated in FIG. 2 is a retainer 35, one at each end of crossbeam 43 to prevent excess axial displacement of the breast roller 1. Cable 34 is threaded through a series of fenders 38 (FIG. 1) that impact against the inner surface of the roller when the cable 34 begins to oscillate too wildly and suppresses the oscillations. The cable is tensioned between the retainers 35 at each end by conically shaped ends 39, with their bases outward, that fit into sleeves 36 with outside threads that screw into the inside threaded retainers. Bronze disks 53 that position rings 55 in the ends of the roller are mounted on the retainer.

In one embodiment of the upper hydrostatic bearing 4' strips 48 and 49 of ceramic are disposed in each longitudinal web 7' and 8' respectively. Ceramic strips will last longer in the event that the recirculated water has abrasive fillers suspended in it. The webs 9 at the entrance ends can also be of ceramic.

The top view of FIG. 2 also shows chambers 5' and 6' and axially spaced partitions 11 between the longitudinal webs 7', 8', and 9'.

FIG. 1 shows, finally, how the lower crossbeam 43 can be attached to a wire table which is represented by the beam 75 and battens or foils 77, all indicated by the dot-and-dash lines.

The headbox outlet slot or nozzle 54 expels the pulp suspension into the gap 50 between wires 51 and 52. The pulp suspension does not travel far since the nozzle is located very close to the breast rollers 1 and 1' due to the relatively small diameter of the rollers, of generally less than 200 mm.

The crossbeams 43 can also accommodate mechanisms that adjust the parallel relationship of the breast roller 1' to the roller 1 and that can also be employed to vary the tension and adjust the width of the gap between the breast rollers 1 and 1'.

Figure 3:
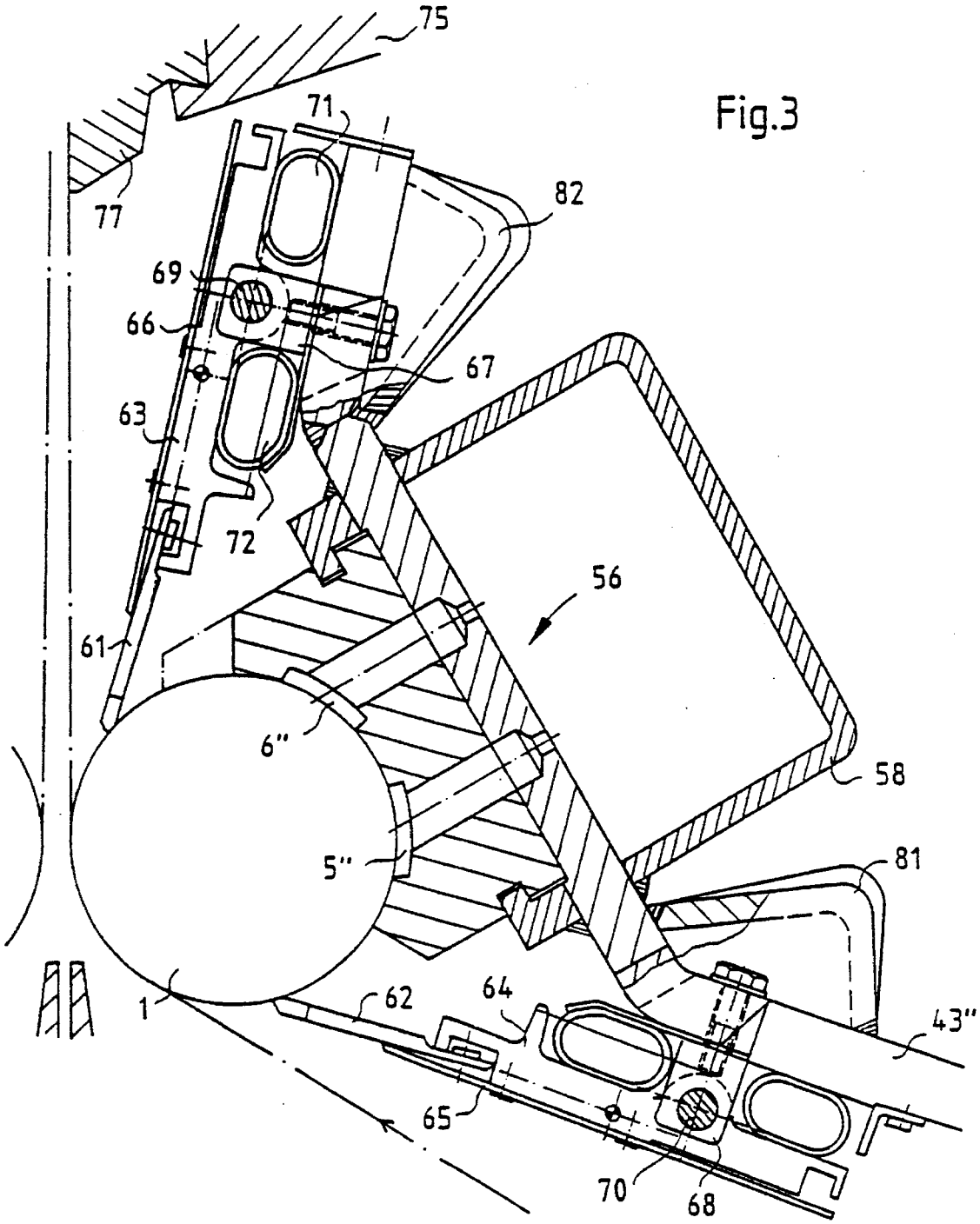
FIG. 3 illustrates another embodiment of a hydrostatic bearing system for supporting a roller having a smaller diameter.

FIG. 3 illustrates an embodiment of the invention in which the headbox outlet slot or nozzle is directed upward and the breast rollers are alongside each other, rather than one roller being above and one being below. This embodiment includes a hydraulic bearing block 56 with chambers and channels for intercepting hydraulic bearing lubricant. These function differently than in the embodiment illustrated in FIG. 1. Scrapers 61 and 62 are at opposite circumferential ends of the hydraulic bearing block arrangement. The scrapers are resiliently secured in respective holders 63 and 64 by respective springs 66 and 65 adjacent to and disposed in parallel with the roller next to the bearing block 56. The scrapers are forced against the surface of the roller 1 by the inflatable cushions 71 and 72. Each scraper thus pivots in bearings 67 and 68 around bolts 69 and 70.

The bearing block 56 has two resiliency chambers 5" and 6" which are distributed along the circumference of the roller. Fluid, e.g., water, is supplied through a channel in the crossbeam 43" that also extends essentially parallel to the breast roller 1. There are web dewatering mechanisms downstream of the breast roller 1 in the path of the wire. The initial dewatering mechanism 77 is illustrated as mounted on a beam 75. Such mechanisms can be omitted if the section is not a forming section.

Fluid channel 58 conveys fluid to the fluid chambers 5" and 6". Take-out channels 81 and 82 remove leaking fluid.

A further embodiment having two resiliency chambers 5''' and 6''' is illustrated in FIG. 4. The first web 8" has a sealing strip 49' that fits into a dovetail groove. The web 8" is essentially parallel to a tangent at that point to the breast roller 1'. At the intake end, there is another sealing strip 9" which is also secured in a dovetail groove.

Also illustrated are angles a'=60° to 150°, a=135° to 180°, and b=70° to 100°.

a' is the angle between one radius of the roller that extends toward a midline of the roller entrance web 9" and a second radius toward a midline through the second pressure web between the last resiliency chamber and the reintroduction chamber.

a is the angle between one radius of the roller that extends toward a midline of the roller entrance web 9" and a second radius that extends toward the midline of the roller exit sealing strip.

b is the angle between one radius extending toward the midline of the exit sealing strip and a second radius extending to where the wire first contacts the roller.

It is preferable to ensure that the resilient force exerted by the hydrostatic bearing liquid or water is powerful enough to counteract and approximately equal the force exerted by the tensioned wire on the breast roller.

The webs between the resiliency chambers 5 and 6, 5' and 6', 5" and 6" and 5''' and 6''' can be approximately half as wide along the circumference of the roller, i.e. half as thick, as the adjacent chambers themselves. The width of the chamber 17 for unpressurized leaked water is not critical.

The ability to vary the force exerted by the sealing strip 20 against the roller is an important aspect of the invention. The invention allows the user to reduce the force exerted by the sealing strip substantially to zero while the machine is being started up in order to prevent the rotation of the roller from being impeded due to adhesive friction with the strip. A significant purpose of this variability is to establish an operating speed at which not much liquid or water will be present either where the circumference of the roller enters the vicinity of the bearing or where it travels by the sealing strip. As the force exerted by the sealing strip increases, specifically, the hydrostatic gap at the downstream web of the bearing block 4" or 4''' will increase and that at the intake web will decrease. The roller will accordingly be tilted more or less around an imaginary axis until little or no water emerges against the direction of rotation between the roller and the upstream web of the hydrostatic bearing.

The force applied by the sealing strip 20 in another embodiment is varied by computerized controls in accordance with the wire tension and the web travel speed to ensure constantly optimal operating conditions, specifically with little or no water escaping at the roller entrance end web of the hydrostatic bearing.

The sealing strip 20 in still another embodiment is applied to the roller at an angle to the orientation of the three webs in the hydrostatic bearing. This ensures that the pressure exerted by the strip will result in the most acute angle possible, less than 30°, to the surface of the adjacent web and that the strip will accordingly mainly affect the width of the gap at the two outer sealing strips.

To prevent extreme variations in the pressure applied by the sealing strip as the head of the sealing strip wears down and its foot shifts position, the depression that accommodates the tubular cushion is shaped to ensure that the area of effective contact between the cushion and the strip will vary little, if at all, as a function of its travel. This shape is illustrated in the drawing Figures.

The width along the circumference of the roller or the thickness of the webs 7 and 8 or of strips 48 and 49 between the respective chambers 5, 6 or 5', 6' and the reintroduction chamber 17 is significant for constricting the flow of water under pressure along the roller. This width should accordingly be between 28% and 80%, and preferably 40%, of the width of the chambers along the circumference of the roller.

The type of bearing specified herein can be used for any type of roll, roller, or cylinder and its use is not limited to a breast roller or even only in a paper making machine.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A wire or felt guiding arrangement for a web of fiber pulp suspension, comprising:

a first and a second breast roller on respective opposite sides of a pulp suspension outlet from a headbox and defining a pulp gap between the rollers generally where the rollers are closest together;

a respective taut wire or felt passing under tension partially around each roller and through the pulp gap so that the headbox suspension outlet ejects suspension between the wires or felts toward the pulp gap;

means defining a respective hydrostatic bearing engaging an outer surface of each of the rollers and extending longitudinally in a cross-machine direction of the roller along the length of the roller for supporting each of the rollers against the tension exerted thereon by the respective wire or felt;

each roller being biased against the hydrostatic bearing by at least one of gravity and the respective wire or felt under tension, each roller being positioned along its entire length by the hydrostatic bearing and by one or both of the force of its own weight and the tension provided by the respective wire or felt, thereby providing a continuous hydrostatic roller support over the entire roller length;

each roller circumference forming a first arc disposed against the bearing substantially opposite a second arc of the circumference that the wire or felt engages.

2. The guiding arrangement apparatus as in claim 1, wherein the ejection outlet is so arranged and the rollers are so arranged that one of the rollers is an upper roller disposed above the other lower roller.

3. The guiding arrangement apparatus as in claim 3, wherein at least the upper roller comprises a hollow cylinder.

4. The guiding arrangement apparatus as in claim 2, further comprising roller suspension means for preventing the upper roller from falling out of its bearing while the wire felt is not present against the upper roller.

5. The guiding arrangement apparatus as in claim 4, wherein the suspension means comprises longitudinally extending means extending between the ends of the roller and a retainer at each end of the roller for holding the longitudinally extending means.

6. The guiding arrangement as in claim 5, wherein the retainer has an inside thread and further comprises a sleeve having an outside thread that screws into the retainer; a conically shaped member attached at each end of the longitudinally extending means.

7. The guiding arrangement as in claim 5, wherein the longitudinally extending means comprises means selected from the group consisting of a cable, pipe, rod, band and wire.

8. The guiding arrangement as in claim 5, wherein at least one fender is mounted around the longitudinally extending means for engaging an inner surface of the roller.

9. The guiding arrangement as in claim 1, wherein each roller has a circumference and each hydrostatic bearing has along an arc of the circumference of the roller at least two circumferentially separated resiliency chambers which are each pressurized by liquid, the bearing having a first upstream end web generally engaging the roller where the circumference of the roller enters the region approaching the resiliency chambers and a second downstream end web generally engaging the roller where the roller leaves the resiliency chambers to inhibit pressurizing liquid from flowing out of the region of the bearing.

10. The guiding arrangement as in claim 9, further comprising a bearing block for each roller in which the resiliency chambers are defined, the chambers define a circumferential region of resiliency at each bearing block, the resiliency region having the first upstream end web engaging the roller where the circumference of the roller enters the region of resiliency and the second downstream end web generally engages the roller where the roller leaves the resiliency region and pressurizing liquid may flow out of the bearing.

11. The guiding arrangement as in claim 9, further comprising a third web generally engaging the roller and disposed between the circumferentially separated resiliency chambers.

12. The guiding arrangement as in claim 9, further comprising a bearing liquid collection and reintroduction chamber disposed beyond the two resiliency chambers in the direction of roller rotation, a sealing strip along a side of the reintroduction chamber which is away from the resiliency chambers for sealing off the reintroduction chamber from the roller; and means for biasing the sealing strip against the surface of the roller.

13. The guiding arrangement as in claim 12, wherein the means for biasing comprises a tubular cushion pressurized by a fluid, the strip having an edge away from the roller, and the cushion pressing against that edge of the strip.

14. The guiding arrangement as in claim 12, wherein a first angle between one radius of each roller that extends toward a midline of the first end web and a second radius extending toward a midline of the sealing strip is between 135° and 180°; and a second angle between a third radius extending toward a midline of the sealing strip and a fourth radius extending toward where the wire first contacts the roller is between 70° and 100°; and the first and second angles together are at most 275°.

15. The guiding arrangement as in claim 9, wherein the resiliency chambers are approximately equal in circumferential width.

16. The guiding arrangement as in claim 15, wherein the webs are approximately equal in circumferential width.

17. The guiding arrangement as in claim 16, wherein the resiliency chambers are between 1.25 to 3.5 times as wide along the circumference of the rollers as the width of the webs in the direction of roller rotation.

18. The guiding arrangement as in claim 16, wherein the resiliency chambers are approximately twice as wide circumferentially as the webs.

19. The guiding arrangement as in claim 9, wherein the webs have surfaces toward the roller and circumferentially between the resiliency chambers, and the web surfaces are curved to match the curved surface of the roller.

20. The guiding arrangement as in claim 19, wherein the webs have edges with surfaces that face the roller and match the curvature of the roller and seal the escape of the liquid that provides the resilience.

21. The guiding arrangement as in claim 20, wherein the edge surfaces are selected from strips of polytetrafluoroethylene or ceramic.

22. The guiding arrangement as in claim 12, wherein the region of resiliency includes an angle of 60° to 150° between a radius of the roller where the wire or felt first contacts the roller and a radius at the circumferential outlet edge of the liquid reintroduction chamber.

23. The guiding arrangement as in claim 12, further comprising bearing blocks for bearing the rollers and in which the webs are defined; the bearing blocks being extractable laterally from the bearing, the bearing blocks defining and accommodating the resiliency chambers.

24. The guiding arrangement as in claims 23, further comprising a component of the hydrostatic bearing adjacent to the sealing strip for securing the bearing blocks.

25. The guiding arrangement as in claim 24, wherein the component further comprises channels for transmitting the hydrostatic fluid.

26. The guiding arrangement as in claim 23, further comprising run-off channels for fluid leaking out in the vicinity of the end of the hydrostatic bearing block opposite the roller.

27. The guiding arrangement as in claim 23, further comprising a crossbeam that extends at least over the width of the wire or felt; the bearing blocks being mounted on the crossbeam; the crossbeam has channels for supplying and removing hydrostatic fluid to the resiliency chambers.

28. The guiding arrangement as in claim 1, wherein each roller is not more than 200 mm in diameter.

29. The guiding arrangement as in claim 10, further comprising partitions provided at intervals longitudinally spaced along the length of the roller and subdividing the resiliency chambers along the length of the bearing.

30. The guiding arrangement as in claim 1, further comprising at least one scraper adjacent the hydrostatic bearing block for scraping off fluid adhering to the roller.

31. The guiding arrangement as in claim 1, wherein each roller comprises a cylinder of fiber-reinforced plastic having a coating of an elastomer.

32. The guiding arrangement as in claim 31, wherein the elastomer comprises a soft polyurethane with a Shore A hardness of 80 to 90.

33. The guiding arrangement as in claim 13, further comprising means for applying a variable pressure to each cushion to control the force applied by the sealing strips toward the roller.

34. The wire guiding arrangement as in claim 9, wherein each roller circumference has an arc of 60° to 150° engaging said hydrostatic bearing, including said resiliency chambers and said first and second end webs.

35. A wire or felt guiding arrangement for a web of fiber pulp suspension, comprising:

a first lower and a second upper breast roller on respective opposite sides of a pulp suspension outlet from a headbox and defining a pulp gap between the rollers generally where the rollers are closest together;

a respective taut wire or felt passing under tension partially around each roller and through the pulp gap so that the headbox suspension outlet ejects suspension between the wires or felts toward the pulp gap;

means defining a respective hydrostatic bearing engaging on outer surface of each of the rollers and extending longitudinally in a cross-machine direction of the roller along the length of the roller for supporting each of the rollers against the tension exerted thereon by the respective wire or felt;

each roller being biased against the hydrostatic bearing by at least one of gravity and the respective wire or felt under tension; and further comprising:

roller suspension means for preventing the upper roller from falling out of its bearing while the wire or felt is not present against the upper roller, said suspension means comprising a longitudinally extending means extending through the roller and having a surface that impacts against an inner surface of the upper roller when the longitudinally extending means begins to oscillate, thereby to suppress the oscillations.

36. The guiding arrangement apparatus as in claim 35, wherein the suspension means comprises longitudinally extending means extending between the ends of the roller and a retainer at each end of the roller for holding the longitudinally extending means.

37. The guiding arrangement as in claim 36, wherein the retainer has an inside thread and further comprises a sleeve having an outside thread that screws into the retainer; a conically shaped member attached at each end of the longitudinally extending means.

38. The guiding arrangement as in claim 36, wherein the longitudinally extending means comprises means selected from the group consisting of a cable, pipe, rod, band and wire.

39. The guiding arrangement as in claim 36, wherein at least one fender is mounted around the longitudinally extending means for engaging an inner surface of the roller.

40. The guiding arrangement as in claim 39, comprising a plurality of fenders through which the longitudinally extending means extends.

* * * * *